United States Patent [19]

Wasson

[11] Patent Number: 4,559,134

[45] Date of Patent: Dec. 17, 1985

[54] CONTROL OF FROTH FLOTATION SEPARATION

[75] Inventor: George E. Wasson, Eighty Four, Pa.

[73] Assignee: Conoco Inc., Wilmington, Del.

[21] Appl. No.: 676,897

[22] Filed: Nov. 30, 1984

[51] Int. Cl.[4] ..... B03D 1/02

[52] U.S. Cl. ..... 209/166; 209/1; 209/169; 209/170

[58] Field of Search ..... 209/1, 166, 169, 170; 364/555, 502

[56] References Cited

U.S. PATENT DOCUMENTS

| | | | |
|---|---|---|---|
| 3,471,010 | 10/1969 | Pick et al. . | |
| 3,551,897 | 12/1970 | Cooper | 364/502 |
| 3,719,090 | 3/1973 | Hathaway . | |
| 3,779,070 | 12/1973 | Cushman et al. . | |
| 4,133,746 | 1/1979 | Dopson . | |
| 4,488,248 | 12/1984 | Okada et al. | 364/555 |

FOREIGN PATENT DOCUMENTS

| | | | |
|---|---|---|---|
| 2095697 | 10/1982 | United Kingdom | 209/164 |
| 518232 | 8/1976 | U.S.S.R. | 209/1 |
| 593742 | 2/1978 | U.S.S.R. . | |
| 747528 | 7/1980 | U.S.S.R. | 209/1 |
| 973167 | 11/1982 | U.S.S.R. | 209/165 |

OTHER PUBLICATIONS

Microtrac Particle Size Monitors–Leeds Northrup Instruments, St. Petersburg, Florida, 8–83, Tech–M 2M.

*Primary Examiner*—Bernard Nozick

*Attorney, Agent, or Firm*—William A. Mikesell, Jr.

[57] ABSTRACT

In a froth flotation beneficiation, the rate of addition of collector reagent is varied in response to the change in particle size effected by the beneficiation, as determined by comparing a size analysis of solid particles in one of the separated streams with a size analysis of solid particles in the feed stream.

6 Claims, 1 Drawing Figure

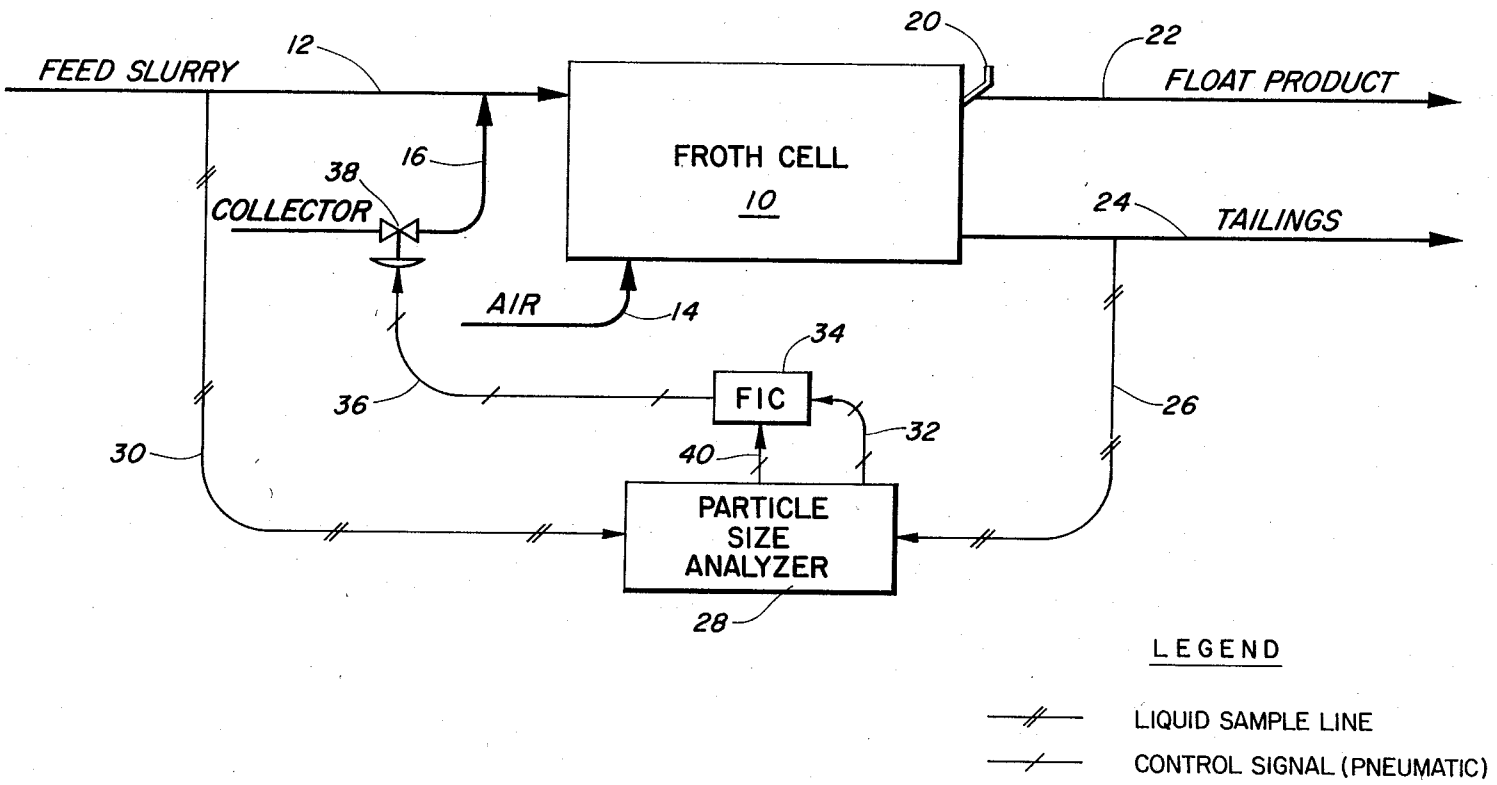
FLOAT PRODUCT
TAILINGS
22
24
26
20
FROTH CELL
10
32
34
FIC
PARTICLE SIZE ANALYZER
28
40
14
AIR
16
38
COLLECTOR
36
12
FEED SLURRY
30
LEGEND
LIQUID SAMPLE LINE
CONTROL SIGNAL (PNEUMATIC)

CONTROL OF FROTH FLOTATION SEPARATION

FIELD OF THE INVENTION

This invention relates to control of mineral separation by froth flotation, and more particularly to control of the rate of addition of a reagent, such as collector, to a froth flotation separation in response to a determination of the degree of average particle size change effected by the separation.

DESCRIPTION OF THE PRIOR ART

Minerals such as metal ores and coal have long been treated by flotation as one technique for producing a beneficiated product. In froth flotation, the comminuted feed material in the form of a water slurry is admixed with reagents, such as a frothing agent and a collector, and passed to a froth cell. In the froth cell, the mixture is agitated, and air is sparged or otherwise introduced into the suspension. A layer of froth is formed on the top of the liquid, with the froth being skimmed off as one product of the separation. The interaction of various reagents with differing ores and minerals has been studied extensively, and is reported in textbooks such as, for example, *Flotation* by A. M. Gaudin, McGraw-Hill, 1957.

Although flotation as a beneficiation step has been known for many years, control of the several variables which affect its separation effectiveness has been primarily an art, highly dependent on the skill of the operator. Only within the past few years have there been commercial installations incorporating any continuous automatic control of froth flotation of coal.

Among the froth flotation control methods proposed in the prior art is, for example, U.S. Pat. No. 3,471,010 to Pick et al, which teaches measurement of the quantity of froth overflow and adjustment of the tailings discharge rate in response to the measurement. U.S. Pat. No. 3,551,897 to Cooper discloses a control system wherein about 10 process variables are measured and fed into a computer, which solves an economic profitability equation and adjusts about 5 process variables in response to the calculation. U.S. Pat. No. 4,133,746 to Dopson teaches measuring the mass flow rate of froth overflow and adjusting the rate of aeration air in response to the measurement. USSR Pat. No. 593,742 to Basin et al discloses electrode measurement of the ion concentration in the material being separated, and adjustment of reactants in response to the measurement.

The particle size of the material undergoing treatment is the subject of U.S. Pat. No. 3,719,090 to Hathaway, which discloses an instrument for measuring particle size and solid content of a plurality of flowing slurries, e.g. with ultrasonics; the plural outputs are used to control various size reduction processes such as crushing or grinding. U.S. Pat. No. 3,779,070 similarly teaches measurement of particle size distribution and solids content in a flowing slurry by ultrasonics, and control of ore classification in response to the measurement.

SUMMARY OF THE INVENTION

According to the invention, there is provided method and appartus for controlling a flotation separation by measuring the solids particle size in the feed to a froth flotation cell, measuring the solids particle size in the tailings from the cell, calculating the change in particle size effected by the cell operation, and controlling the rate of addition of reagent to the cell in response to the calculation.

In a preferred embodiment, a water slurry feed of finely divided solids comprising bituminous coal and mineral impurities is separated by a froth flotation cell to produce a froth-floated product enriched in coal content, and a non-floated tailings depleted in coal content; the particle size of solids in the feed and in the tailings are measured and compared, and the result of the comparison is used to control the rate of addition of collector reagent to the cell. An especially advantageous control configuration comprises a primary control loop in which a measurement of particle size in the tailings is the variable which is compared to the set point of a flow controller adjusting the rate of collector addition, and a secondary control loop in which a measurement of particle size in the feed is utilized to adjust the set point of the flow controller.

Thus, it is an object of the invention to provide method and apparatus for automatically controlling operation of a froth flotation separation for optimal effective use of reagent. It is another object of the invention to provide automatic control of a froth flotation cell whereby the control is minimally affected by changes in the flow rate and concentration of the feed to the flotation operation.

These and other objects and aspects of the invention are more fully disclosed and described in this specification, the accompanying drawing, and the appended claims.

BRIEF DESCRIPTION OF THE DRAWING

The sole FIGURE is a schematic flow diagram of a froth flotation separation according to the present invention.

DETAILED DESCRIPTION OF THE INVENTION

The invention will be described in connection with a froth flotation purification of a finely divided bituminous coal which can contain various clay, pyrite, and other mineral impurities, in a water suspension.

Referring to the drawing, the froth flotation or separation cell 10 receives a feed slurry from a conduit 12, and typically is provided with an air sparger which provides ascending air bubbles from air introduced by way of conduit 14. Collector reagent is added by way of a conduit 16. Cell 10 is provided with an overflow launder or trough 20 which collects floated product for removal by way of conduit 22, and also a conduit 24 located in a lower zone of the cell, which conduit removes nonfloated tailings. The device as described to this point is a conventional froth flotation as is known in the art.

According to the present invention, tailings material in conduit 24 and feed material in conduit 12 are each analyzed to determine the size of the solid particles therein. To this end, a small portion of tailings material is diverted by sample conduit 26 and is passed to analyzer 28. Similarly a small portion of feed material is diverted to analyzer 28 by sample conduit 30. These samples, once analyzed, can be returned from the analyzer to the process by conduits not shown. Analysis of the two sample streams can be separate and simultaneous by plural devices, or intermittent and alternating in a single analyzer. One analyzer useful in the practice of this invention is the MICROTRAC Particle Size Monitor manufactured by Leeds and Northrup Instruments of St. Petersburg, Florida, and is described in their bulletin Tech-M 2 M 8-83, the disclosure of which is incorporated herein by reference. The analyzer output signal representative of tailings particle size is represented by control signal 32, which is passed to a flow controller such as FIC 34, which can comprise any of numerous commercially available pneumatic or electronic controllers, with or without an indicator function. Signal 32 represents the primary process variable, and adjusts the output of FIC 34 by way of control signal 36 to change the setting of a control valve 38 located in conduit 16. The analyzer output signal representative of feed particle size is represented by control signal 40, and is passed to FIC 34 to adjust its set point as the secondary, cascaded, or 'override' process variable. In addition to the collector, other reagents such as frothing agent can be added e.g. in proportion to feed slurry rate.

Froth flotation of most coals results in a coal product having an average particle size larger than that of the feed, and conversely a tailings material having an average particle size smaller than that of the feed. The tailings analysis is highly dependent on the collector addition rate, and thus serves as the primary control loop. Gradual changes in the feed material size dictate the degree of separation feasible, and the measurement of this parameter is thus used to vary the FIC 34 set point.

In one embodiment of my invention, FIC 34 can comprise a micro computer which is especially advantageous in combination with the MICROTRAC analyzer. This particular analyzer can be programmed to produce an output representing the total of all the volumes of particles within its sensitivity range, e.g. from 3.3 to 300 microns, or it can be programmed to produce an output representing one or more narrow 'slices' of that total range, e.g. the band 150–212 microns, or the band 212–300 microns. Thus, it can be set to watch rather specific components of the feed and tailings streams, such as clays, pyrites, or coal. And as the characteristics of the upstream operation, such as the coal mining, or crusher, or the washer plant, change, the analyzer band of interest can be changed accordingly. As an example, the feed stream can be analyzed to measure the particle size range which is predominantly coal, whereas the tailings stream can be analyzed for the particle size range for predominantly silica, pyrites, or both.

The size consist of the feed to the froth cell depends on the history and source of the material, and will differ greatly e.g. from an operation wherein black water pond solids are being reclaimed to one wherein the fines of an operating coal cleaning plant are being treated, and will in fact differ significantly from one coal cleaning plant to another, and in a single cleaning plant with passage of time. However, the feed to a coal flotation cell is generally at least −28 mesh Tyler, or smaller than 589 microns. The effectiveness of the separation is greatly dependent on the degree of liberation of the mineral impurity particles from their adhesion to or inclusion in the coal particles, as is known in the art.

In operation, assume a deficiency of collector rate in conduit 16; this results in some of the coarser coal product not being floated, which is detected as an increase in tailings particle size in conduit 26 by analyzer 28. Signal 32 from analyzer 28 then adjusts FIC 34 to transmit a signal 36 to open valve 38 farther. FIC 34 operates to attempt to maintain the size of tailings in conduit 24 at a constant value, for example −100 mesh Tyler (−147 microns), by adjusting collector addition rate, until such time as a change of feed size is detected in sample stream 30. An increase detected here by analyzer 28 results in generation of signal 40 which increases the set point of FIC 34. One control logic which can be incorporated in FIC 34 includes an economizing on collector addition rate to the lowest value which will achieve the desired separation. To illustrate, when signal 32 has remained constant at the desired value for a predetermined time interval, FIC 34 will operate to decrease the flow rate through valve 38 to the point where an increase in tailings size just begins to appear at conduit 26, and then either holds valve 38 constant, or increases its setting very slightly.

The effect of tailings particle size on coal recovery by the froth cell can be illustrated by the following data, which were obtained by making overall material balances around a froth cell during its operation as part of a commercial coal preparation plant in West Virginia:

TABLE I

| | Run No. | | |
|---|---|---|---|
| | A | B | C |
| Tailings Size (Wt % solids, +200 mesh Tyler) | 23.8 | 57.6 | 64.4 |
| Coal Recovery (In product, as wt % of feed) | 93.0 | 57.8 | 26.3 |
| Collector Useage (Fuel oil, lb./t coal feed) | 1.62 | 0.98 | 0.44 |
| Product Ash (lb./t coal in product) | 7.35 | 5.15 | 5.68 |

The economic significance of this example can be more readily appreciated when one realizes that the size of this plant was such that the coal lost to the tailings in Run C amounted to more than 50 tons of product per hour. It will also be noted from these data that the greatly increased recovery of coal in Run A as compared with Run C carried with it only a slight increase in product ash content.

Specific reagents do not form a part of my invention. However, kerosene and fuel oil are exemplary of suitable collectors, and MIBC (methyl isobutyl carbinol), a suitable frothing agent. Further, although the coal product is normally contained in the froth, it is possible to add a coal depressant, which results in coal being the 'sink' product, with pyrites and other minerals in the froth.

The present specification and claims comprise an explanation of the principle and of the presently preferred mode of construction and operation of my invention. It should be understood that reasonable variation and modification are within the scope of this specification and the appended claims.

I claim:

1. The method of beneficiating a feed slurry of finely divided solids comprising coal and other minerals by froth flotation which comprises:

(a) passing said feed slurry to a flotation zone, (b) adding a collection reagent to said feed slurry, (c) inducing formation of a froth in said flotation zone, (d) recovering as a product from said flotation zone the thusformed froth and a major portion of said coal, (e) also recovering from said flotation zone a tailings stream containing an increased proportion of said other minerals to said coal as compared with the proportion in said feed slurry, (f) analyzing solids particle size in said tailings stream and producing therefrom a first control signal, (g) generating an error signal representative of the magnitude and direction of the difference between said first control signal and a predetermined set point, (h) adjusting the rate of adding collection reagent in step b) responsive to said error signal, (i) analyzing solids particle size in said feed slurry and producing therefrom a second control signal, and (j) adjusting said set point responsive to said second control signal.

2. The method of claim 1 wherein the size range of particles analyzed to produce said first control signal is the same as the size range of particles analyzed to produce said second control signal.

3. The method of claim 1 wherein the size range of particles analyzed to produce said first control signal is different from the size range of particles analyzed to produce said second control signal.

4. The method of claim 3 wherein said coal comprises bituminous coal, said collection reagent comprises kerosene or fuel oil, the solids content of said feed slurry has a maximum particle size of about 589 microns, and said first control signal is representative of particle size in the range of about 147 to about 1 micron.

5. Apparatus for separating finely divided coal from admixture with other minerals in an aqueous slurry which comprises:

(a) flotation vessel means, (b) feed conduit means for passing a feed slurry to said flotation vessel means, (c) collector conduit means for passing collector reagent to said flotation vessel means, (d) agitation means for inducing froth within said flotation vessel means, (e) froth product conduit means for removing froth containing a coal-enriched portion of said feed slurry from said flotation vessel means, (f) tailings conduit means for removing tailings liquid comprising a second coal-depleted portion of said feed slurry from said flotation vessel means, (g) analyzer means for analyzing said tailings liquid to ascertain particle size of solids therein and to produce a first control signal representative of said particle size, (h) flow adjusting means on said collector conduit means for adjusting the flow rate therethrough, (i) controller means for regulating said flow adjusting means responsive to the relationship of said first control signal with respect to a predetermined set point value, (j) analyzer means for analyzing said feed slurry to ascertain particle size of solids therein and to produce a second control signal representative of said particle size, and (k) means for adjusting said predetermined set point value responsive to said second control signal.

6. Apparatus of claim 5 wherein a single analyzer means serves as the means of both steps (g) and (j) during alternate time periods.

* * * * *